US011423872B1

(12) United States Patent
He et al.

(10) Patent No.: US 11,423,872 B1
(45) Date of Patent: Aug. 23, 2022

(54) DYNAMIC RANGE ENHANCEMENT (DRE) CONTROL IN ADAPTIVE NOISE CANCELLATION (ANC) APPLICATIONS

(71) Applicant: CIRRUS LOGIC INTERNATIONAL SEMICONDUCTOR LTD., Edinburgh (GB)

(72) Inventors: Ku He, Austin, TX (US); Xiaofan Fei, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 0 days.

(21) Appl. No.: 17/369,723

(22) Filed: Jul. 7, 2021

Related U.S. Application Data

(60) Provisional application No. 63/089,815, filed on Oct. 9, 2020.

(51) Int. Cl.
*G10K 11/178* (2006.01)

(52) U.S. Cl.
CPC ..... *G10K 11/1785* (2018.01)

(58) Field of Classification Search
CPC ..... G10K 11/1785
See application file for complete search history.

(56) References Cited

U.S. PATENT DOCUMENTS

| | | | | |
|---|---|---|---|---|
| 9,071,267 | B1 | 6/2015 | Schneider et al. | |
| 9,391,576 | B1 | 7/2016 | Satoskar et al. | |
| 9,998,826 | B2 | 6/2018 | Satoskar | |
| 10,785,568 | B2 | 9/2020 | Das et al. | |
| 2016/0126968 | A1* | 5/2016 | Lesso | H03M 1/18 341/155 |
| 2016/0286310 | A1* | 9/2016 | Das | G10L 19/167 |
| 2021/0184638 | A1* | 6/2021 | Shen | H03F 3/181 |

* cited by examiner

*Primary Examiner* — David L Ton
(74) *Attorney, Agent, or Firm* — Mitch Harris, Atty at Law, LLC; Andrew M. Harris

(57) ABSTRACT

A system that reproduces an output signal including dynamic range enhancement (DRE) reduces audible artifacts generated by changes in operating range of the dynamic range enhancement (DRE) when the output signal includes an adaptive noise canceling (ANC) component. A first detection circuit determines an input signal amplitude and a second detection circuit determines a measure of an amplitude of a noise canceling component of the input signal. A control circuit determines whether the amplitude of the noise canceling component is significant with respect to the input signal amplitude and controls characteristics of a dynamic range enhancer to override a default behavior of the dynamic range enhancer if the amplitude of the noise-canceling component is significant with respect to the input signal amplitude. The characteristics may include rise/fall times of a gain control of the dynamic range enhancer and may be controlled in multiple separate frequency bands.

26 Claims, 7 Drawing Sheets

DYNAMIC RANGE ENHANCEMENT (DRE) CONTROL IN ADAPTIVE NOISE CANCELLATION (ANC) APPLICATIONS

The present Application Claims priority under 35 U.S.C. § 119(e) to U.S. Provisional Patent Application 63/089,815 filed on Oct. 9, 2020, the disclosure of which is incorporated herein by reference.

BACKGROUND

1. Field of Disclosure

The field of representative embodiments of this disclosure relates to amplifier methods and circuits that control dynamic range enhancement (DRE) in amplifier output stages in adaptive noise cancellation (ANC) applications by taking into account whether a noise-canceling component of an input signal is significant with respect to the total amplitude of the input signal.

2. Background

Audio output systems that deliver power to acoustic output transducers, such as loudspeakers or micro speakers may include a dynamic range enhancer to provide optimum dynamic range, while maintaining low noise operation. When output signal amplitude is large, an analog gain of the output stage is set to a high gain level, while when the output signal amplitude is lower, the analog gain of the output stage is reduced, in order to reduce the baseband noise level of the output stage. In systems that generate the input signal provided to the output stage from a digital-to-analog converter, a digital gain applied in generating the input signal is adjusted in concert with the analog gain, so that the signal level produced by the output stage is unchanged by the adjustments in gain made by the dynamic range enhancer. Since changes in gain of the dynamic range enhancer occur when the output signal is relatively large, e.g., in a system having a dynamic range of 96 dB and a dynamic range enhancer operating range change of 6 dB, the output amplitude may be as high as +90 dB relative to zero-signal level when the higher-amplitude end of the dynamic range enhancer operating range is activated.

However, in applications in which the output stage is producing an output signal that includes an adaptive noise canceling (ANC) component, the actual net acoustic output is ideally only the program audio level, which may be at a very low amplitude with respect to the output signal. Under such conditions, changes in the dynamic range enhancer operating point may cause audible clicks/pops or other undesirable audible artifacts. Any DC offset difference between the operating modes, which may be selections between different amplifier paths, may also generate audible transients when the net ambient audio energy is low. In the presence of an ANC signal that is periodic, or near-periodic. any transients may become more audible due to the periodicity.

Therefore, it would be advantageous to provide a system incorporating dynamic range enhancement that reduces or eliminates audible artifacts when changing DRE operating point in systems that incorporate ANC.

SUMMARY

Reduced audible artifacts due to dynamic range enhancement (DRE) operating range changes may be accomplished in systems and their methods of operation.

The systems reproduce an audio input signal having a combined noise-canceling component and a program component and include a first detection circuit for determining an amplitude of the audio input signal, a second detection circuit for determining a measure of an amplitude of the noise-canceling component, an output stage for generating an audio output signal from the audio input signal, and a control circuit for controlling characteristics of a dynamic range enhancer of the output stage. The control circuit controls characteristics of the dynamic range enhancer by determining whether the amplitude of the noise-canceling component is significant with respect to the amplitude of the audio input signal, and if the amplitude of the noise-canceling component is significant with respect to the amplitude of the audio input signal, adjusts characteristics of the dynamic range enhancer to override its default behavior.

The summary above is provided for brief explanation and does not restrict the scope of the Claims. The description below sets forth example embodiments according to this disclosure. Further embodiments and implementations will be apparent to those having ordinary skill in the art. Persons having ordinary skill in the art will recognize that various equivalent techniques may be applied in lieu of, or in conjunction with, the embodiments discussed below, and all such equivalents are encompassed by the present disclosure.

DETAILED DESCRIPTION OF ILLUSTRATIVE EMBODIMENT

The present disclosure encompasses audio systems having an output driver stage with dynamic range enhancement (DRE) and that generate an audio output signal including a component due to adaptive noise canceling (ANC). The systems determine, from an audio input signal, the amplitude of the noise-canceling component, and whether or not the noise-canceling component is significant with respect to the total amplitude of the input signal being reproduced. If the anti-noise component is significant with respect to the total amplitude, characteristics of the DRE are adjusted to prevent artifacts such as pops from being audible in the audio output signal, by adjusting characteristics of a dynamic range enhancer associated with the output stage, in to override a default behavior of the dynamic range enhancer.

Figure 1:
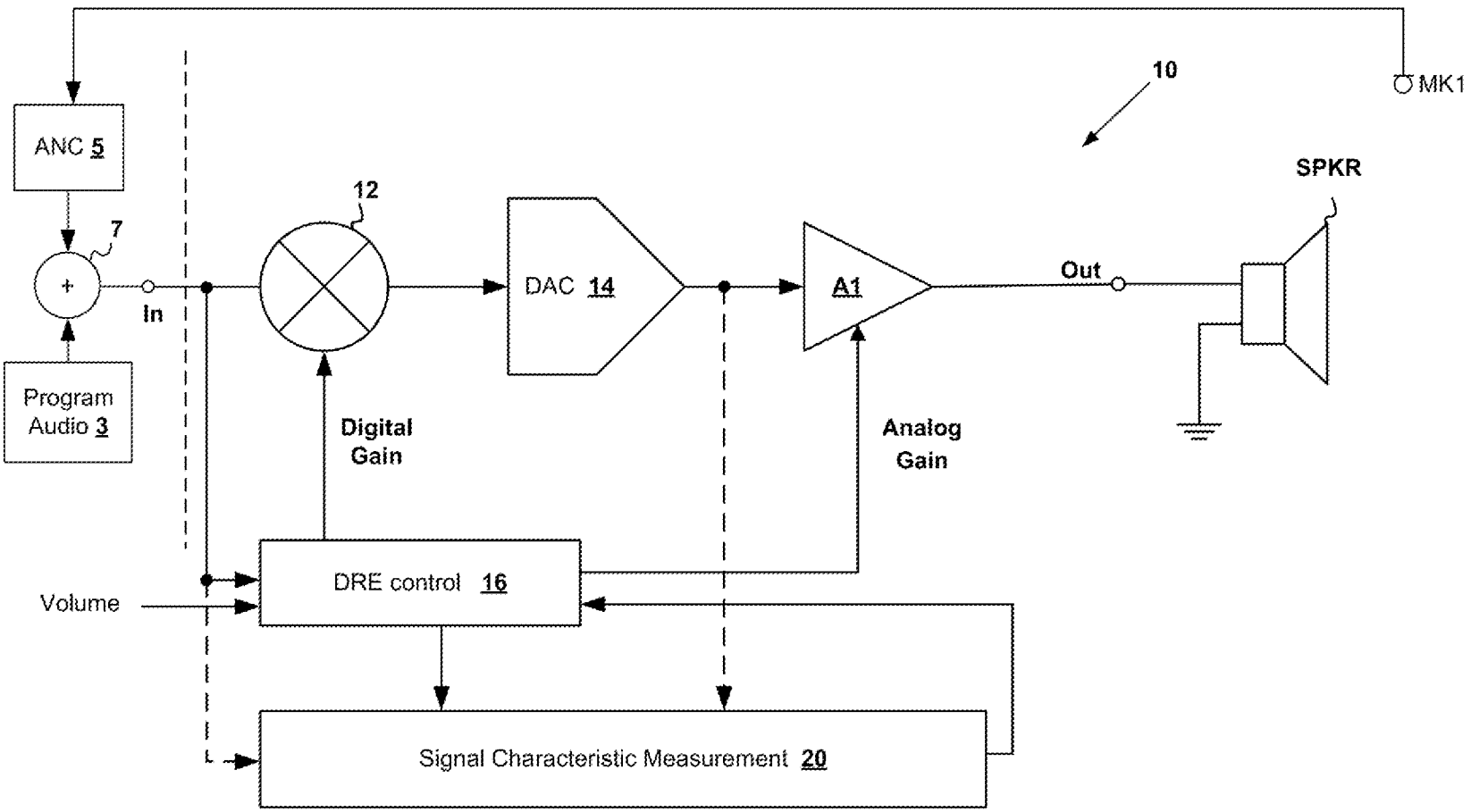
FIG. 1 is a block diagram of an example system 10 in which techniques according to an embodiment of the disclosure are practiced.

Referring now to FIG. 1, a block diagram of an example system 10 is shown, in accordance with an embodiment of the disclosure. Example system 10 is illustrated as an audio amplification system for providing an output signal Out to an audio transducer such as a speaker SPKR. Output signal Out is derived from a digital audio input signal In and to which a digital gain value Digital Gain is applied by a multiplier 12. An example source of an audio input signal In is also illustrated, in which a program audio component of digital audio input signal In is provided by a program audio block 3 and is combined by a summer 7 with an ANC component provided by an ANC block 5 that receives a signal from a microphone MK1 near speaker SPKR in order to cancel ambient noise. The output of multiplier 12 is converted to an analog signal by a digital-to-analog converter (DAC) 14, and the output of DAC 14 is multiplied by an analog gain value Analog Gain applied by an adjustable-gain amplifier stage A1. A dynamic range enhancement (DRE) control block 16 controls digital gain value Digital Gain and analog gain value Analog Gain in conformity with a volume control value Volume, so that, for a given value of volume control value Volume, the product of digital gain value Digital Gain and analog gain value Analog Gain is constant. By adjusting analog gain value Analog Gain upward, the upper end of the dynamic range of output signal Out is increased, with a consequent increase in the value of the noise floor, by adjusting analog gain value Analog Gain downward, the noise floor is lowered, increasing noise performance, by increasing signal to noise ratio (SNR) and/or signal to distortion ratio (SDR) of system 10. In this manner, system 10 provides DRE by observing a signal level (signal amplitude) of digital input signal In, and according to the various embodiments described below, is informed by a signal characteristic measurement block 20 that determines whether or not an adaptive noise canceling (ANC) component is present in digital input signal In, so that artifacts such as pops and clicks due to changes in analog gain value Analog Gain may be avoided by overriding a default behavior of DRE control block 16. The default behavior, of changing the operating range of the DRE by adjusting analog gain value Analog Gain (and consequently digital gain value Digital Gain) according to the signal level of digital input signal In, is accomplished by either preventing or delaying a shift in analog gain value Analog Gain when, for example, output signal Out is primarily canceling ambient noise, or by controlling the timing of, randomizing, or adjusting a rate of change of, analog gain value Analog Gain in response to signal level changes at digital input signal In. Under such conditions, even though output signal Out may have high amplitude, the net acoustic output of speaker SPKR in combination with the ambient acoustic environment may be of low amplitude, making artifacts generated in output signal Out easily audible. In the following description, "attack" is used to indicate the initiation of an upward shift in analog gain value Analog Gain and "release" is used to indicate the restoration of analog gain value Analog Gain to a lower value, which as explained in further detail below, corresponds to the timing of a shift in a two-state DRE system or the rate/timing of multiple shifts in >2-state DRE system.

While details of amplifier A1 are not shown, it will be understood that amplifier A1 may be an analog signal amplifier, a pulse-width modulated class-D type amplifier or any other audio power output stage in which the operating dynamic range may be shifted according to a control value. Amplifier A1 may also be a multi-path audio output stage, for example amplifier A1 may have a voltage path and a current path, or a high-voltage path and a low-voltage path for handling output signals of different amplitude ranges, and the change in analog gain value Analog Gain may be due wholly, or in part, to switching between multiple signal paths in a multi-path amplifier output stage, so that an enhanced dynamic range results from selection of the signal path. Analog gain value Analog Gain (and consequently digital gain value Digital Gain) may have only two states, e.g., a higher digital gain value Digital Gain for a current signal path through amplifier A1, and a lower digital gain value for a higher-analog-gain voltage signal path through amplifier A1, thus providing a two-state DRE functionality. Alternatively, analog gain value Analog Gain and digital gain value Digital Gain may be adjustable over a continuous or quasi-continuous range of values, thus providing an adjustable dynamic operating range of system 10 that corresponds to a range of values, thus providing a more finely-adjustable DRE.

Figure 2:
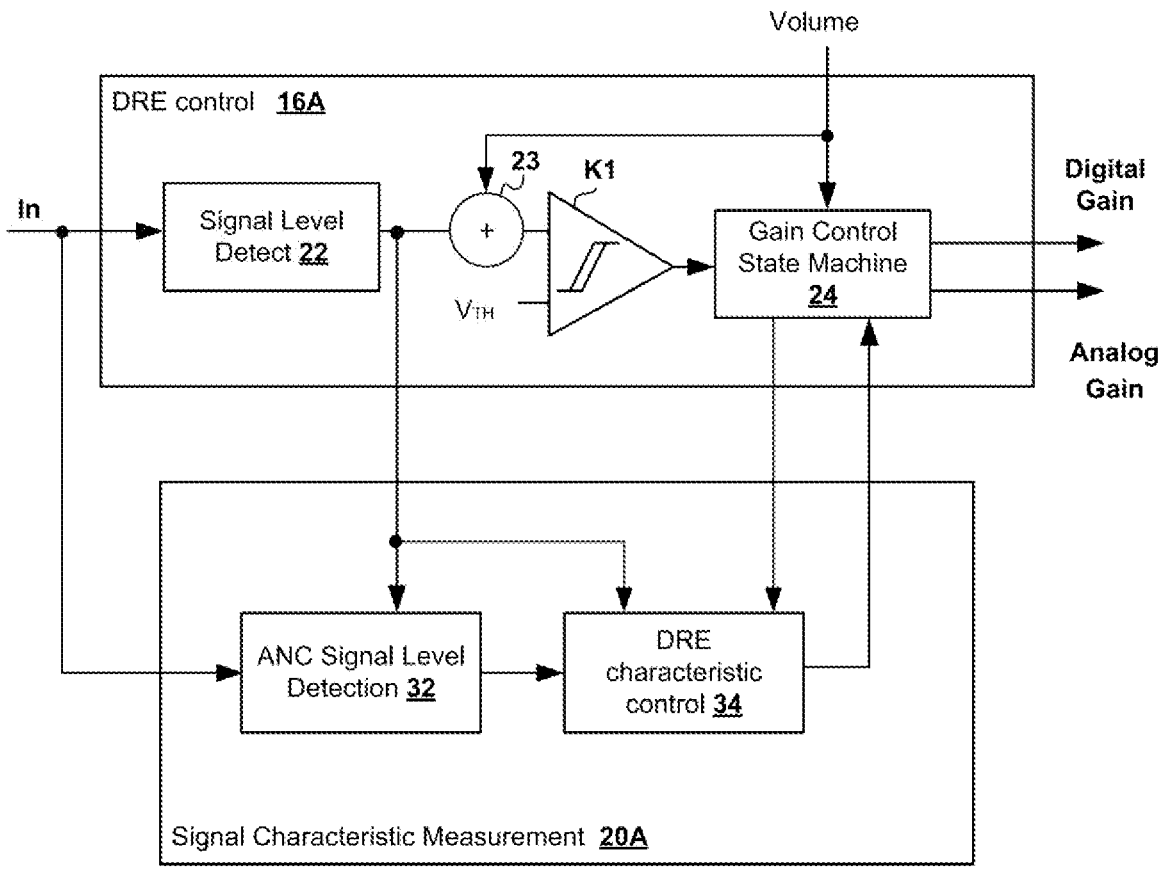
FIG. 2 is a block diagram illustrating an example dynamic-range enhancement (DRE) control block 16A coupled to an example signal characteristic measurement block 20A that may be used to implement DRE control block 16 and signal characteristic measurement block 20 in example system 10 of FIG. 1.

Referring now to FIG. 2, an example dynamic-range enhancement (DRE) control block 16A is shown coupled to an example signal characteristic measurement block 20A that may be used to implement DRE control block 16 and signal characteristic measurement block 20 in example system 10 of FIG. 1. DRE control block 16A receives digital audio input signal In and determines a signal level (amplitude) of digital audio input signal In with a signal level detector 22, e.g. a peak detector, root-mean square (RMS) detector, or other suitable signal level detector. The output of signal level detector 22 is combined with volume control level volume by an adder 23, the output of which is compared to one or more thresholds by a hysteresis comparison block K1. Volume control value Volume is added to compensate for gain that will be added to digital gain value Digital Gain according to a desired volume level. Hysteresis comparison block K1 provides a control signal to a gain control state machine 24 that determines analog gain value Analog Gain and digital gain value Digital Gain from the signal level indication(s) and volume control input value Volume. Signal characteristic measurement block 20A receives digital input signal In, which is provided to an ANC signal level detection block 32 that determines whether or not the signal level of the ANC component of digital input signal In is significant with respect to the program component of digital input signal In, which may be provided from signal level detection block 22 of DRE control block 16A as shown. A DRE characteristic control block 34 is responsive to the ANC component signal level and the overall signal level to inform gain control state machine 24 to override default behavior due to the presence of an ANC component that is not masked by the program component of digital input signal In, in other words, whether the ANC component of digital input signal In is significant with respect to the overall digital input signal In on an ongoing basis.

Figure 3:
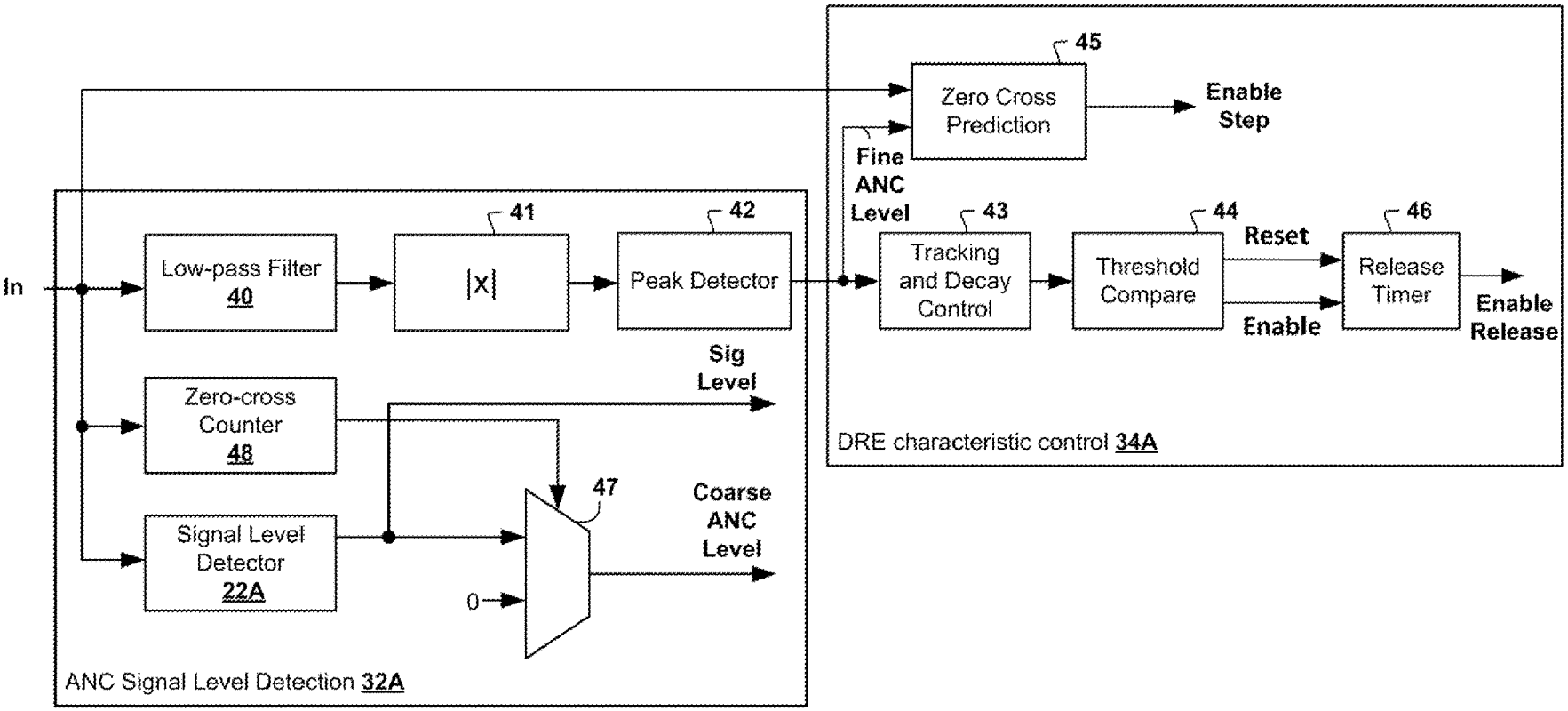
FIG. 3 is a block diagram illustrating details of an example adaptive noise canceling (ANC) signal level detection block 32A and an example DRE characteristic control block 34A that may be used to implement ANC signal level detection block 32 and DRE characteristic control block 34 in example signal characteristic measurement block 30 of FIG. 2.

Referring now to FIG. 3, a block diagram is shown, illustrating details of an example adaptive noise canceling (ANC) signal level detection block 32A and an example DRE characteristic control block 34A that may be used to implement ANC signal level detection block 32 and DRE characteristic control block 34 in example signal characteristic measurement block 30 of FIG. 2. ANC signal level detection block 32A receives digital audio input signal In, which is provided to inputs of a low-pass filter 40, a zero-cross counter 48, and a signal level detector 22A. The output of low-pass filter 40 is provided to an absolute value block 41 and a peak detector 42 to produce a fine indication of ANC component signal level Fine ANC Level, which has latency due to filtering, but provides an accurate indication of low-frequency content in digital audio input signal In, which is presumed to be due to the ANC component of digital audio input signal In. Low-pass filter 40 may be a programmable bandwidth filter, so that system 10 may be tailored to various applications. Generally, low-pass filter 40 will have a roll-off frequency approximately 300 Hz for mobile device applications, but a roll-off frequency in a range from 10 Hz to 500 Hz may be desirable for different ANC applications. The output of signal level detector 22A, which has a lower latency than the output of peak detector 42, is provided to an input of a selector 47, which selects the output of signal level detector 22A when zero-cross counter 48, which is periodically reset, indicates a low count value indicating that digital audio input signal In has predominately low-frequency content. If zero-cross counter 48 has a high count value, digital audio input signal In has predominately higher-frequency content and may be presumed to be predominantly program audio, and the selector 47 selects a "0" input value. The output of selector 47 provides a coarse measurement of the ANC signal component Coarse ANC Level, which has low latency, which is used to provide low-latency indication to determine when ANC is engaging. DRE characteristic control 34A receives fine indication of ANC component signal level Fine ANC Level, which is provided to a zero-cross prediction block 45, which predicts a next zero-crossing in digital audio input signal In and produces a controls signal Enable Step, which is used to enable the DRE of the output stage of system 10 to change operating dynamic range. Synchronizing the changes in DRE operating range with zero-crossings of the audio signal being reproduced avoids generating transients in the output signal Out and fine indication of ANC component signal level Fine ANC Level, which is used to determine when ANC is disengaging or to measure a static level of the ANC signal, may be used to qualify whether or not DRE changes should be allowed at all and/or to control release of DRE changes as described in further detail below. Fine indication of ANC component signal level Fine ANC Level is also provided to a tracking and delay control block 43 to control the rate and/or timing of the release of upward DRE operating range changes. A threshold compare block 44 compares the output of tracking and decay control block 43 to threshold values to generate a reset control signal Reset and an enable control signal Enable that may reset and enable, respectively, a release timer 46 that generates a control signal Enable Release that is used to delay the release of upward DRE range operating changes. Release timer 46 is reset when DRE is attacking and release is enabled via control signal Enable once the measured ANC component signal level falls below a predetermined threshold and release timer 46 then counts a release interval after which the DRE is released if the release timer is not disabled or reset by conditions at its inputs.

Figure 4:
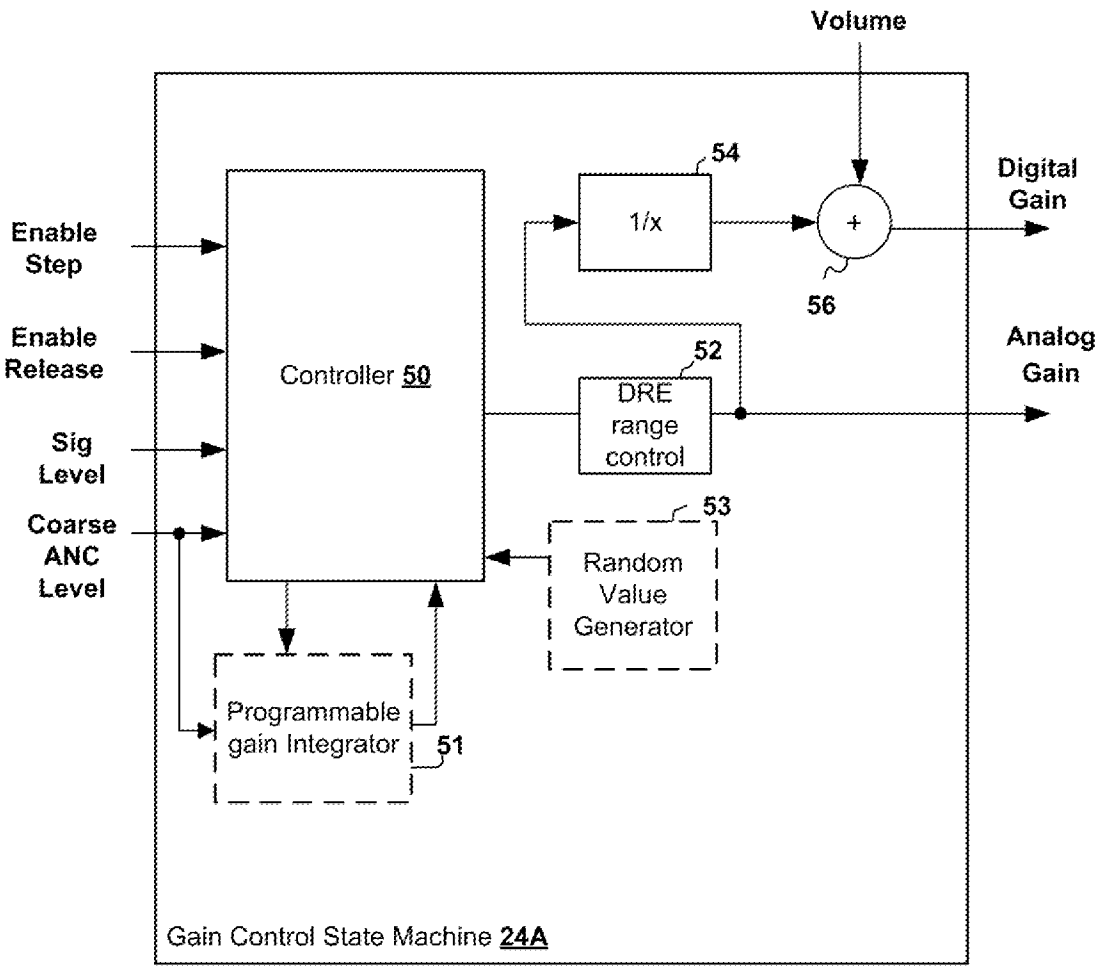
FIG. 4 is a block diagram illustrating details of an example gain control state machine 24A that may be used to implement gain control state machine 24 in example DRE control circuit 20A of FIG. 2.

Referring now to FIG. 4, a block diagram illustrating details of an example gain control state machine 24A that may be used to implement gain control state machine 24 in example DRE control circuit 20A of FIG. 2, is shown. Control signals Enable Step, Enable Release and signal levels Sig Level and Coarse ANC Level are provided to a controller 50, that may be a logic-based state machine, a microcontroller core with associated program instructions and memory, or any other suitable control block for implementing the state machine described herein. Controller 50 receives control signals Enable Step, Enable Release and signal levels Sig Level and Coarse ANC Level and determines when changes in the DRE operating range should proceed according to whether or not digital audio input signal In is predominated by an ANC component. Controller 50 may use historical information of ANC level detection and also predetermined information, in order to most effectively minimize artifacts generated by the changing of DRE operating modes, or step size in systems with multiple levels of DRE. Controller 50 controls DRE operating range in conjunction with volume control value Volume, by providing a control value to a DRE range control block 52, which generates analog gain control value Analog Gain, and an inversion block 54 generates a control value to which volume control value Volume is added by an adder 56, to generate digital gain control value Digital Gain. Controller 50, or alternatively a discrete logic delay block, synchronize changes in control value Analog Gain and digital gain control value Digital Gain. In some embodiments, gain control state machine 24A may include a programmable gain integrator 51 and/or a random value generator 53 for controlling attack/release timing of the DRE in the presence of a significant ANC component in digital audio input signal In, in order to randomize the occurrence of changes in DRE operating range in order to prevent periodic changing or other repetitive sequences of changes that will be audible. In general, there are four different states that occur when an ANC signal is provided by a system. The ANC signal may be of low or high amplitude and the program audio may be of low or high amplitude, where low amplitude is understood to encompass the "no amplitude" conditions in which ANC is disabled and/or program audio is not present. It is the transitions between these conditions/states that controller 50 reacts to, in order to avoid generating audible artifacts if the change requires a shift in DRE operating range. An example control methodology is illustrated in Table I below.

TABLE I

| | | | DRE Operation | |
|---|---|---|---|---|
| ANC change | Current State | Next State | Hold Range | Dynamic change |
| ANC off, no change | ANC Low/ Program Low | ANC Low/ Program High | Default | Default |
| ANC engaging | ANC Low/ Program Low | ANC High/ Program Low | Hold high noise mode | Fast attack |
| ANC engaging | ANC Low/ Program Low | ANC High/ Program High | Hold high noise mode | Fast attack |
| ANC engaging | ANC Low/ Program High | ANC High/ Program Low | Hold high noise mode | |
| ANC engaging | ANC Low/ Program High | ANC High/ Program High | Hold high noise mode | |
| ANC disengaging | ANC High/ Program Low | ANC Low/ Program Low | | Slow release |
| ANC disengaging | ANC High/ Program High | ANC Low/ Program Low | | Slow release |
| ANC disengaging | ANC High/ Program Low | ANC Low/ Program High | Hold high noise mode | |

TABLE I-continued

| ANC change | Current State | Next State | DRE Operation | |
|---|---|---|---|---|
| | | | Hold Range | Dynamic change |
| ANC disengaging | ANC High/ Program High | ANC Low/ Program High | Hold high noise mode | |
| ANC on | ANC High/ Program Low | ANC High/ Program Low | Hold high noise mode | |
| ANC on | ANC High/ Program High | ANC High/ Program High | Hold high noise mode | |

The slow release may be provided by controller, or may be provided by the design of tracking and decay control 43 in DRE characteristic control 34A.

Figure 5:
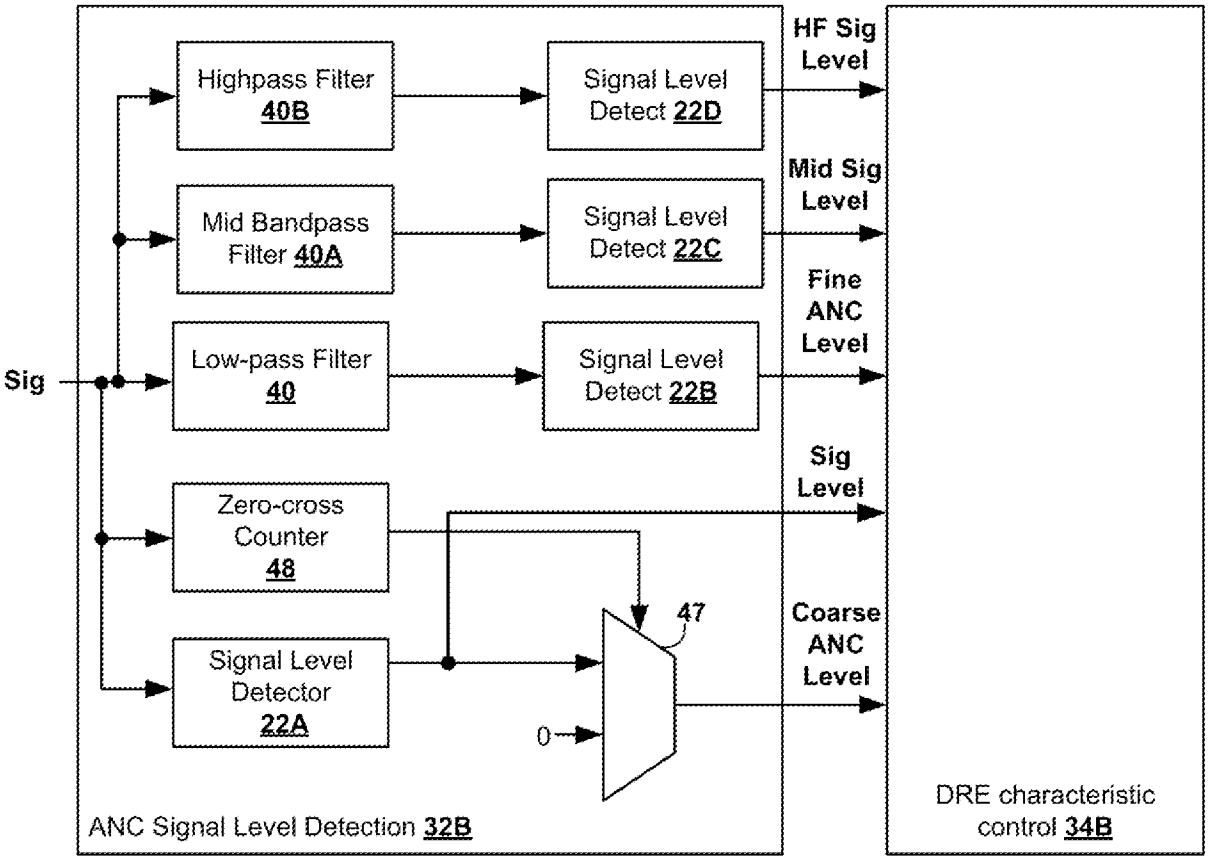
FIG. 5 is a block diagram illustrating details of another example adaptive noise canceling (ANC) signal level detection block 32B and DRE characteristic control block 34B that may be used to implement ANC signal level detection block 32 and DRE characteristic control block 34 in example signal characteristic measurement block 20A of FIG. 2.

Referring now to FIG. 5, a block diagram is shown, illustrating details of another example adaptive noise canceling (ANC) signal level detection block 32B and DRE characteristic control block 34B that may be used to implement ANC signal level detection block 32 and DRE characteristic control block 34 in example signal characteristic measurement block 20A of FIG. 2. ANC signal level detection block 32B is similar to ANC signal level detection block 32A of FIG. 3, so only differences between them are described below. ANC signal level detection block 32B, addition to low-pass filter 40, zero-cross counter 48, signal level detector 22A and selector 47, includes a mid-frequency band-pass filter 40A and a high-pass filter 40B. Each of mid-frequency band-pass filter 40A, high-pass filter 40B and low-pass filter 40 may have an associated signal level detection block 22C, 22D and 22B, respectively, that generate a high-frequency signal level HF Sig Level, mid-frequency signal level Mid Sig Level and fine indication of ANC component signal level Fine ANC Level, respectively, so that DRE characteristic controller 34B has further information about non-ANC program audio components of digital audio input signal In, for controlling characteristics of DRE operation via DRE characteristic control 34B. In one embodiment, DRE Characteristic control block 34B compares the output of each of signal level detection blocks 22C, 22D and 22B to associated predetermined thresholds, and permits the DRE operating range to shift only when the output of signal detection block 22C indicates that mid-frequency energy is present in digital audio input signal In and the outputs of signal detection blocks 22B and 22D indicate that energy in the low and high frequency bands is absent.

Figure 6:
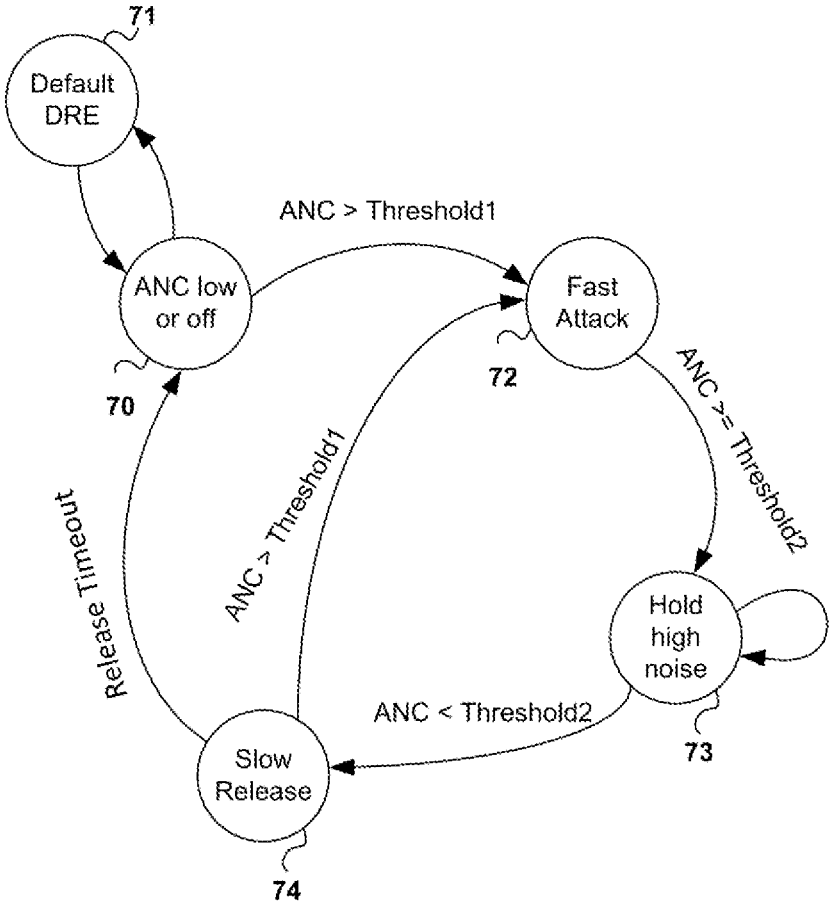
FIG. 6 is a state diagram illustrating operation of example system 10 of FIG. 1 in accordance with an embodiment of the disclosure.

Referring now to FIG. 6, a state diagram illustrating operation of example system 10 of FIG. 1 in accordance with an embodiment of the disclosure, is shown. In state 70, ANC is either off or at low signal level, and default DRE behavior is maintained in state 71. Once the ANC component level is greater than a threshold level Threshold 1, state 72 is entered and a fast attack proceeds to set the DRE operating range to the high noise operating range in state 73. Until the ANC component level falls below another threshold level Threshold2, operation is maintained in state 73, with the DRE operating range held to the high noise level. Once the ANC component level falls below threshold level Threshold2, a slow release timer is started from state 74, and once the release timeout expires, the system enters state 70, in which the hold on the DRE operating range is removed and default behavior is resumed. During the release timeout in state 74 if the ANC component level again exceeds threshold value Threshold1 operation proceeds instead to state 72.

Figure 7:
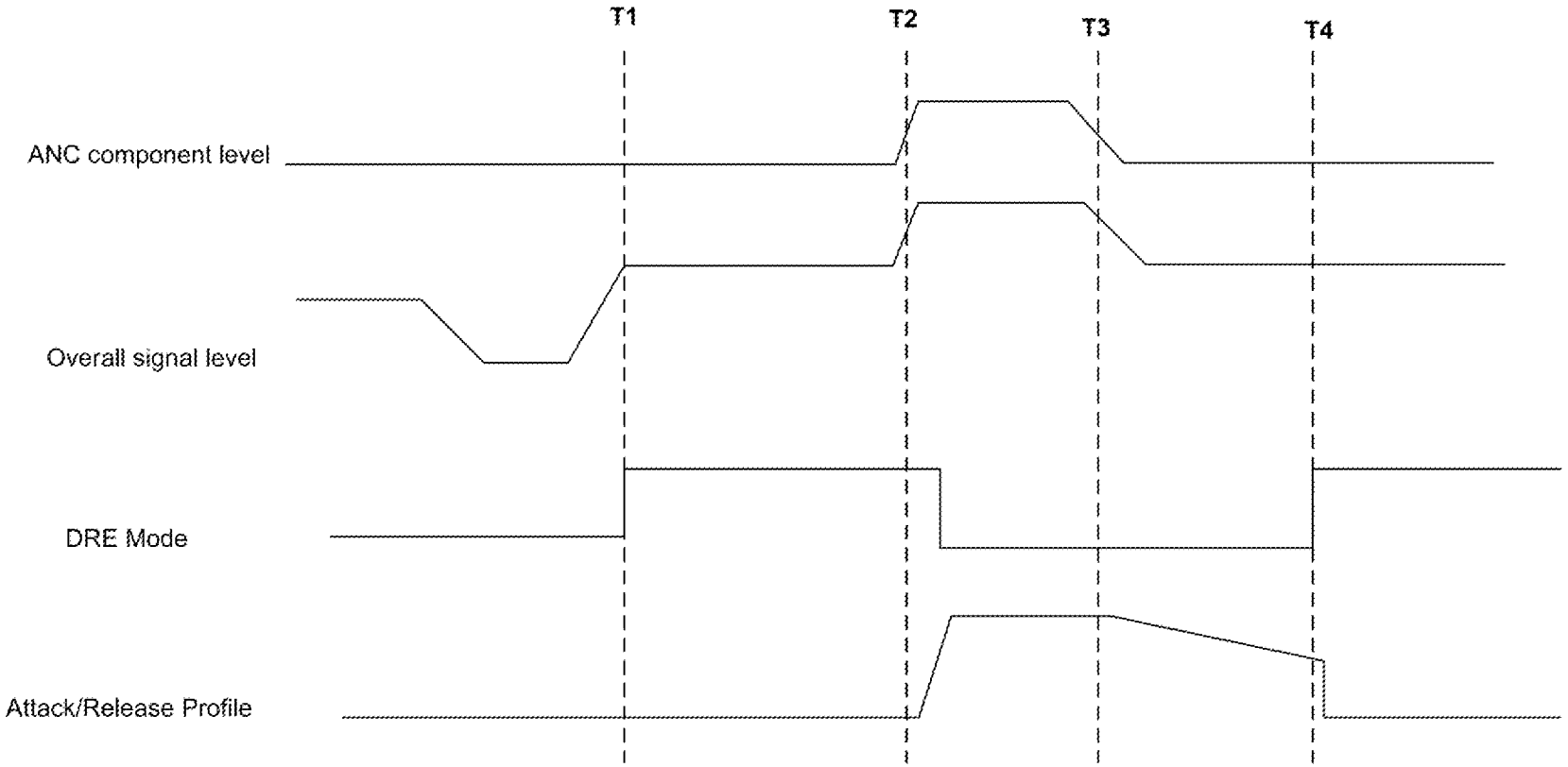
FIG. 7 is a signal timing diagram illustrating operation of example system 10 of FIG. 1 in accordance with an embodiment of the disclosure.

Referring now to FIG. 7, a signal timing diagram illustrating operation of example system 10 of FIG. 1 in accordance with an embodiment of the disclosure, is shown. Level Sig Level of digital input signal In is shown increasing up to time T1, at which time the DRE operating range is changed according to assertion of the illustrated DRE mode. A time T2, the level of the ANC component Coarse ANC Level increases, and as soon as the attack/release profile transitions after time T2, the DRE mode is restored to the high noise state. At time T3, the level of the ANC component Coarse ANC Level decreases, but due to the slow release of the attack/release profile, the DRE Mode is held in the high noise state until time T4, which is the time at which the release timer expires.

In summary, this disclosure shows and describes circuits, systems and methods of operation of the systems and circuits that reproduce an audio input signal having a combined noise-canceling component and a program component. The systems and circuits include a first detection circuit for determining an amplitude of the audio input signal, a second detection circuit for determining a measure of an amplitude of the noise-canceling component, an output stage for generating an audio output signal from the audio input signal, the output stage including a dynamic range enhancer for altering a dynamic range of the audio output signal in accordance with the amplitude of the audio input signal and an adjustable operating range of the dynamic range enhancer, and a control circuit for controlling characteristics of the dynamic range enhancer by determining whether the amplitude of the noise-canceling component is significant with respect to the amplitude of the audio input signal, and responsive to determining that the amplitude of the noise-canceling component is significant with respect to the amplitude of the audio input signal, adjusting the characteristics of the dynamic range enhancer to override a default behavior of the dynamic range enhancer.

In some embodiments, the dynamic range enhancer may include a digital gain control stage having a variable digital gain that is applied to values representative of the audio input signal and an output stage having a digital-to-analog converter that generates an analog output signal from the values representative of the audio input signal according to the variable digital gain and an analog amplifier that receives the analog output signal and generates the audio output signal from the analog output signal. The analog amplifier may apply a variable analog gain to the analog output signal that is an inverse of the variable digital gain so that the gain of the dynamic range enhancer remains constant as the variable digital gain is adjusted to change the operating dynamic range of the dynamic range enhancer. The second detection circuit may include a low-pass filter for filtering the audio input signal to generate an estimate of the noise-canceling component and a signal level detector for detecting an amplitude of the estimate of the noise-canceling component. The control circuit may include a comparison circuit for comparing the detected amplitude of the estimate of the noise-canceling component to the amplitude of the audio input signal to determine whether the amplitude of the noise-canceling component is significant with respect to the amplitude of the audio input signal. In some embodiments, the second detection circuit may include a low-frequency detector for detecting whether or not the audio input signal contains predominantly low-frequency content and a selector that selects between the amplitude of the audio input signal and a zero value in response to the output of the low-frequency detector. The selector may select the amplitude of the audio input signal as a second measure of the amplitude of the noise-canceling component if the audio input signal is predominantly low-frequency content, and may, if the audio input signal is not predominantly low-frequency content, set the second measure of the amplitude of the noise-canceling component to zero. In some embodiments, the control circuit may alter a first rate of change of an upward change in the digital gain of the dynamic range enhancer and a second rate of change of a downward change in the digital gain of the dynamic range enhancer in response to changes in the detected amplitude of the audio input signal. The first measure of the amplitude of the noise-canceling component may be used to trigger an increase in the digital gain of the dynamic range enhancer and the second measure of the amplitude of the noise-canceling component may be used to trigger a decrease in the digital gain of the dynamic range enhancer.

In some embodiments, the comparison circuit may include a first comparator for comparing the measured amplitude of the estimate of the noise-canceling component to a first threshold amplitude and a second comparator for comparing the measured amplitude of the estimate of the noise-canceling component to a second threshold amplitude greater than the first threshold amplitude. The control circuit may, responsive to the measured amplitude of the estimate of the noise-canceling component exceeding the first threshold amplitude, enable a release timer that may determine a first rate of change of an upward change in the digital gain of the dynamic range enhancer. The control circuit may, responsive to the measured amplitude of the estimate of the noise-canceling component exceeding the second threshold amplitude, reset the release timer so that the upward change in the digital gain of the dynamic range enhancer is postponed.

In some embodiments, the control circuit may determine whether or not the amplitude of the noise-canceling component is significant by determining whether or not the program component has sufficient amplitude to mask artifacts generated by changing the digital gain and the analog gain of the dynamic range enhancer. In some embodiments, the control circuit may include a low-pass filter for filtering the audio input signal to generate a low frequency band signal, and at least two bandpass or high-pass filters for filtering the audio input signal to generate higher-frequency band signals. The control circuit may measure amplitudes of the at least two higher-frequency band signals to generate at least two higher-frequency measurements and compare the at least two higher-frequency measurements with corresponding thresholds to determine whether or not the amplitudes of the at least two higher-frequency measurements indicate that the program component has sufficient amplitude to mask the artifacts.

In some embodiments, the control circuit may adjust the characteristics of the dynamic range enhancer to override a default behavior of the dynamic range enhancer by altering a rate of change of at least one of an upward change in the digital gain of the dynamic range enhancer or a downward change in the digital gain of the dynamic range enhancer. In some embodiment, the control circuit may adjust the characteristics of the dynamic range enhancer to override a default behavior of the dynamic range enhancer by altering a step size of the gain of the dynamic range enhancer. In some embodiments, the first detection circuit may determine multiple amplitudes of the audio input signal in multiple corresponding frequency bands, and the control circuit may alter the step size of the gain of the dynamic range enhancer in conformity with the multiple amplitudes of the audio input signal in the multiple corresponding frequency bands. In some embodiments, the control circuit may align changes in the characteristics of the dynamic range enhancer with zero-crossings of the audio input signal. In some embodiments, the control circuit may randomize at least one of a step size of the gain of the dynamic range enhancer or a rate of change of at least one of an upward change in the digital gain of the dynamic range enhancer or a downward change in the digital gain of the dynamic range enhancer in response to changes in the amplitude of the audio input signal.

It should be understood, especially by those having ordinary skill in the art with the benefit of this disclosure, that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense. Similarly, although this disclosure makes reference to specific embodiments, certain modifications and changes may be made to those embodiments without departing from the scope and coverage of this disclosure. Moreover, any benefits, advantages, or solutions to problems that are described herein with regard to specific embodiments are not intended to be construed as a critical, required, or essential feature or element.

While the disclosure has shown and described particular embodiments of the techniques disclosed herein, it will be understood by those skilled in the art that the foregoing and other changes in form, and details may be made therein without departing from the spirit and scope of the disclosure. For example, a priori information about adaptive noise canceling components in the audio signal may be used in combination with the techniques of the disclosed embodiments.

What is claimed is:

1. A method of controlling a dynamic range enhancer (DRE) in an audio system that generates an audio output signal from an audio input signal having a combined noise-canceling component and a program component, the method comprising:

determining an amplitude of the audio input signal;

dynamically adjusting an operating dynamic range of the dynamic range enhancer to alter a dynamic range of the audio output signal in accordance with the amplitude of the audio input signal;

determining a measure of an amplitude of the noise-canceling component of the audio input signal;

performing a comparison of the amplitude of the noise-canceling component and the amplitude of the audio input signal; and responsive to a result of the comparison, adjusting characteristics of the dynamic range enhancer to override a default behavior of the dynamic range enhancer.

2. The method of claim 1, wherein the dynamic range enhancer comprises:

a digital gain control stage having a variable digital gain that is applied to values representative of the audio input signal; and an output stage having a digital-to-analog converter that generates an analog output signal from the values representative of the audio input signal according to the variable digital gain and an analog amplifier that receives the analog output signal and generates the audio output signal therefrom, wherein the analog amplifier applies a variable analog gain to the analog output signal that is an inverse of the variable digital gain so that the gain of the dynamic range enhancer remains constant as the variable digital gain is adjusted to change the operating dynamic range of the dynamic range enhancer.

3. The method of claim 2, wherein the performing a comparison comprises:

extracting a first measure of the amplitude of the noise-canceling component by low-pass filtering the audio input signal to generate an estimate of the noise-canceling component;

measuring an amplitude of the estimate of the noise-canceling component; and comparing the measured amplitude of the estimate of the noise-canceling component to the amplitude of the audio input signal.

4. The method of claim 3, further comprising extracting a second measure of the amplitude of the noise-canceling component from the audio input signal by detecting if the audio input signal is predominantly low-frequency content and using the amplitude of the audio input signal as the second measure of the amplitude of the noise-canceling component if the audio input signal is predominantly low-frequency content, and wherein if the audio input signal is not predominantly low-frequency content, setting the second measure of the amplitude of the noise-canceling component to zero, and wherein the adjusting characteristics of the dynamic range enhancer to override a default behavior of the dynamic range enhancer is performed in conformity with both the first measure and the second measure of the amplitude of the noise-canceling component.

5. The method of claim 4, wherein the adjusting characteristics of the dynamic range enhancer to override a default behavior of the dynamic range enhancer alters a first rate of change of an upward change in the digital gain of the dynamic range enhancer and a second rate of change of a downward change in the digital gain of the dynamic range enhancer in response to changes in the amplitude of the audio input signal, and wherein the first measure of the amplitude of the noise-canceling component is used to trigger an increase in the digital gain of the dynamic range enhancer and the second measure of the amplitude of the noise-canceling component is used to trigger a decrease in the digital gain of the dynamic range enhancer.

6. The method of claim 3, wherein the comparing comprises:

comparing the measured amplitude of the estimate of the noise-canceling component to a first threshold amplitude;

comparing the measured amplitude of the estimate of the noise-canceling component to a second threshold amplitude greater than the first threshold amplitude;

responsive to the measured amplitude of the estimate of the noise-canceling component exceeding the first threshold amplitude, enabling a release timer that determines a first rate of change of an upward change in the digital gain of the dynamic range enhancer; and responsive to the measured amplitude of the estimate of the noise-canceling component exceeding the second threshold amplitude, resetting the release timer so that the upward change in the digital gain of the dynamic range enhancer is postponed.

7. The method of claim 2, wherein the performing a comparison comprises determining whether or not the program component has sufficient amplitude to mask artifacts generated by changing the digital gain and the analog gain of the dynamic range enhancer.

8. The method of claim 7, wherein the determining whether or not the program component has sufficient amplitude to mask artifacts generated by changing the digital gain and the analog gain of the dynamic range enhancer comprises:

filtering the audio input signal to generate a low frequency band signal and at least two higher-frequency band signals;

measuring amplitudes of the at least two higher-frequency band signals to generate at least two higher-frequency measurements; and comparing the at least two higher-frequency measurements with corresponding thresholds to determine whether or not the amplitudes of the at least two higher-frequency measurements indicate that the program component has sufficient amplitude to mask the artifacts.

9. The method of claim 2, wherein the adjusting characteristics of the dynamic range enhancer to override a default behavior of the dynamic range enhancer alters a rate of change of at least one of an upward change in the digital gain of the dynamic range enhancer or a downward change in the digital gain of the dynamic range enhancer in response to changes in the amplitude of the audio input signal.

10. The method of claim 2, wherein the adjusting characteristics of the dynamic range enhancer to override a default behavior of the dynamic range enhancer alters a step size of the digital gain of the dynamic range enhancer.

11. The method of claim 10, wherein the determining an amplitude of the audio input signal determines multiple amplitudes of the audio input signal in multiple corresponding frequency bands, and wherein the altering of the step size of the gain of the dynamic range enhancer is further performed in conformity with the multiple amplitudes of the audio input signal in the multiple corresponding frequency bands.

12. The method of claim 2, wherein the adjusting characteristics of the dynamic range enhancer to override a default behavior of the dynamic range enhancer aligns changes in the digital gain and the analog gain of the dynamic range enhancer with zero-crossings of the audio input signal.

13. The method of claim 2, wherein the adjusting characteristics of the dynamic range enhancer to override a default behavior of the dynamic range enhancer randomizes at least one of a step size of the gain of the dynamic range enhancer or a rate of change of at least one of an upward change in the digital gain of the dynamic range enhancer or a downward change in the digital gain of the dynamic range enhancer in response to changes in the amplitude of the audio input signal.

14. A system for reproduction of an audio input signal having a combined noise-canceling component and a program component, the system comprising:

a first detection circuit for determining an amplitude of the audio input signal;

a second detection circuit for determining a measure of an amplitude of the noise-canceling component;

an output stage for generating an audio output signal from the audio input signal, the output stage including a dynamic range enhancer for altering a dynamic range of the audio output signal in accordance with the amplitude of the audio input signal and an adjustable operating range of the dynamic range enhancer; and a control circuit for controlling characteristics of the dynamic range enhancer by performing a comparison of the amplitude of the noise-canceling component and the amplitude of the audio input signal, and responsive to a result of the comparison, adjusting the characteristics of the dynamic range enhancer to override a default behavior of the dynamic range enhancer.

15. The system of claim 14, wherein the dynamic range enhancer comprises:

a digital gain control stage having a variable digital gain that is applied to values representative of the audio input signal; and an output stage having a digital-to-analog converter that generates an analog output signal from the values representative of the audio input signal according to the variable digital gain and an analog amplifier that receives the analog output signal and generates the audio output signal therefrom, wherein the analog amplifier applies a variable analog gain to the analog output signal that is an inverse of the variable digital gain so that the gain of the dynamic range enhancer remains constant as the variable digital gain is adjusted to change the operating dynamic range of the dynamic range enhancer.

16. The system of claim 15, wherein the second detection circuit comprises:

a low-pass filter for filtering the audio input signal to generate an estimate of the noise-canceling component; and a signal level detector for detecting an amplitude of the estimate of the noise-canceling component, and wherein the control circuit includes a comparison circuit for comparing the detected amplitude of the estimate of the noise-canceling component to the amplitude of the audio input signal.

17. The system of claim 16, wherein the second detection circuit further comprises:

a low-frequency detector for detecting whether or not the audio input signal contains predominantly low-frequency content; and a selector that selects between the amplitude of the audio input signal and a zero value in response to the output of the low-frequency detector, wherein the selector selects the amplitude of the audio input signal as a second measure of the amplitude of the noise-canceling component if the audio input signal is predominantly low-frequency content, and wherein if the audio input signal is not predominantly low-frequency content, sets the second measure of the amplitude of the noise-canceling component to zero.

18. The system of claim 17, wherein the control circuit alters a first rate of change of an upward change in the digital gain of the dynamic range enhancer and a second rate of change of a downward change in the digital gain of the dynamic range enhancer in response to changes in the detected amplitude of the audio input signal, and wherein the first measure of the amplitude of the noise-canceling component is used to trigger an increase in the digital gain of the dynamic range enhancer and the second measure of the amplitude of the noise-canceling component is used to trigger a decrease in the digital gain of the dynamic range enhancer.

19. The system of claim 16, wherein the comparison circuit comprises:

a first comparator for comparing the measured amplitude of the estimate of the noise-canceling component to a first threshold amplitude; and a second comparator for comparing the measured amplitude of the estimate of the noise-canceling component to a second threshold amplitude greater than the first threshold amplitude, and wherein the control circuit, responsive to the measured amplitude of the estimate of the noise-canceling component exceeding the first threshold amplitude, enables a release timer that determines a first rate of change of an upward change in the digital gain of the dynamic range enhancer, and responsive to the measured amplitude of the estimate of the noise-canceling component exceeding the second threshold amplitude, resets the release timer so that the upward change in the digital gain of the dynamic range enhancer is postponed.

20. The system of claim 15, wherein the control circuit performs the comparison by determining whether or not the program component has sufficient amplitude to mask artifacts generated by changing the digital gain and the analog gain of the dynamic range enhancer.

21. The system of claim 20, wherein the control circuit comprises:

a low-pass filter for filtering the audio input signal to generate a low frequency band signal; and at least two bandpass or high-pass filters for filtering the audio input signal to generate higher-frequency band signals, and wherein the control circuit measures amplitudes of the at least two higher-frequency band signals to generate at least two higher-frequency measurements and compares the at least two higher-frequency measurements with corresponding thresholds to determine whether or not the amplitudes of the at least two higher-frequency measurements indicate that the program component has sufficient amplitude to mask the artifacts.

22. The system of claim 15, wherein the control circuit adjusts the characteristics of the dynamic range enhancer to override a default behavior of the dynamic range enhancer by altering a rate of change of at least one of an upward change in the digital gain of the dynamic range enhancer or a downward change in the digital gain of the dynamic range enhancer.

23. The system of claim 15, wherein the control circuit adjusts the characteristics of the dynamic range enhancer to override a default behavior of the dynamic range enhancer by altering a step size of the gain of the dynamic range enhancer.

24. The system of claim 23, wherein the first detection circuit determines multiple amplitudes of the audio input signal in multiple corresponding frequency bands, and wherein the control circuit alters the step size of the gain of the dynamic range enhancer in conformity with the multiple amplitudes of the audio input signal in the multiple corresponding frequency bands.

25. The system of claim 15, wherein the control circuit aligns changes in the characteristics of the dynamic range enhancer with zero-crossings of the audio input signal.

26. The system of claim 15, wherein the control circuit randomizes at least one of a step size of the gain of the dynamic range enhancer or a rate of change of at least one of an upward change in the digital gain of the dynamic range enhancer or a downward change in the digital gain of the dynamic range enhancer in response to changes in the amplitude of the audio input signal.

* * * * *